United States Patent [19]

Unuma

[11] Patent Number: 4,826,337

[45] Date of Patent: May 2, 1989

[54] WEB FEED TRACTOR

[75] Inventor: Sadao Unuma, Obu, Japan

[73] Assignee: Tokai Kogyo Kabushiki Kaisha, Obu, Japan

[21] Appl. No.: 122,845

[22] Filed: Nov. 19, 1987

[30] Foreign Application Priority Data

Nov. 28, 1986 [JP] Japan ..... 61-183850[U]
Dec. 5, 1986 [JP] Japan ..... 61-188158[U]

[51] Int. Cl.[4] ..... B41J 11/30

[52] U.S. Cl. ..... 400/616.2; 226/74; 271/34

[58] Field of Search ..... 400/616, 616.1, 616.2; 226/74, 75; 271/34

[56] References Cited

U.S. PATENT DOCUMENTS 4,510,510 2/1985 Andersson ..... 400/616.1 X
4,614,287 9/1986 Ueno et al. ..... 400/616.1 X

FOREIGN PATENT DOCUMENTS 1436715 1/1969 Fed. Rep. of Germany ... 400/616.2
155977 9/1983 Japan ..... 400/616.2
55772 3/1984 Japan ..... 400/616.2
41566 2/1986 Japan ..... 400/616.2

*Primary Examiner*—Edgar S. Burr
*Assistant Examiner*—James R. McDaniel
*Attorney, Agent, or Firm*—Dennison, Meserole, Pollack & Scheiner

[57] ABSTRACT

A web feed tractor includes an endless feed belt having feed pins projecting from the outer surface thereof, and a pair of side frames disposed along the opposite edges of the feed belt. A driving pulley is rotatably supported between one ends of the side frames and is adapted to engage the inner surface of the arcuate driving portion of the feed belt so as to drive the feed belt. A belt guide is provided between the side frames and has a guide surface adapted to guide the inner surface of the arcuate driven portion and the upper and lower reaches of the feed belt. The guide surface is positioned in longitudinally aligned relation to the feed pins of the feed belt and has a width substantially equal to the diameter of the feed pin.

4 Claims, 3 Drawing Sheets

WEB FEED TRACTOR

BACKGROUND OF THE INVENTION

1. Field of the Invention

The present invention relates to tractors for feeding continuous webs in printers and computers.

2. Description of the Prior Art

Such tractors may include a pair of side frames, a driving pulley rotatably supported between one ends of the side frames, a belt guide disposed between the side frames adjacent the driving pulley, and an endless feed belt trained around the driving pulley and the belt guide. The feed belt has on the outer surface thereof a predetermined number of feed pins engageable with equispaced perforations formed in a continuous web. The inner surface of the feed belt has a plurality of belt teeth spaced apart along the length thereof. The driving pulley has on the outer surface thereof pulley teeth adapted to mesh with the belt teeth on the arcuate driving portion of the feed belt. Thus, the feed belt may ba driven in a predetermined direction by rotation of the driving pulley, causing the continuous web to be fed in the predetermined direction.

The belt guide is usually formed integrally with one of the side frames, and has a guide surface having substantially the same width as the feed belt and extending in the travelling direction of the feed belt. The inner surface of the arcuate driven portion and the upper and lower reaches of the feed belt is guided in contacting engagement with the whole width of the guide surface of the belt guide.

In the foregoing web feed tractors, however, during driving of the feed belt, great friction is produced between the inner surface of the arcuate driven portion and the upper and lower reaches of the feed belt and the guide surface of the belt guide which is in contacting engagement with the whole width of the feed belt. Such a frictional force disadvantageously causes unstable travel of the feed belt and therefore, smooth web feed may not be effected.

Furthermore, in the prior art tractors, when the continuous web undergoes an external force greater than the meshing force between the belt teeth of the arcuate driving portion of the feed belt and the pulley teeth of the driving pulley, the arcuate driving portion of the feed belt is moved outwardly from the driving pulley, causing slip, jumping or other difficulties of the feed belt.

SUMMARY OF THE INVENTION

It is, accordingly, an object of the present invention to provide an improved web feed tractor which eliminates the foregoing disadvantages.

It is another object of the present invention to provide such a tractor wherein the frictional force developed between the inner surface of the feed belt and the guide surface of the belt guide is substantially reduced, thereby permitting lighter travel of the feed belt.

It is a further object of the present invention to provide such a tractor which may limit the amount of deflection of the feed belt from the intended straight path and thereby prevent disengagement of the feed pins from the perforations in the continuous web.

It is a still further object of the present invention to provide such a tractor which may restrain outward movement of the feed belt and thereby positively maintain the meshing engagement between the belt teeth of the feed belt and the pulley teeth of the driving pulley.

According to the present invention, a web feed tractor includes an endless feed belt having an arcuate driving portion, an arcuate driven portion and upper and lower reaches extending between these arcuate driving and driven portions. The feed belt has on the outer surface thereof a predetermined number of feed pins engageable with equispaced perforations formed in a continuous web. A pair of side frames are disposed along the opposite edges of the feed belt. A driving pulley is rotatably supported between one ends of the side frames and is adapted to engage the inner surface of the arcuate driving portion of the feed belt so as to drive the feed belt. A belt guide is provided between the side frames and has a guide surface adapted to guide the inner surface of the arcuate driven portion and the upper and lower reaches of the feed belt. The guide surface is positioned in longitudinally aligned relation to the feed pins of the feed belt and has a width substantially equal to the diameter of the feed pin.

In the preferred embodiment of the present invention, one of the side frames is formed with an arcuate belt restraining extension extending outwardly of and closely along the outer surface of the arcuate driving portion of the feed belt and adapted to restrain outward movement of the feed belt.

Thus, in the web feed tractor of the present invention, the guide surface of the belt guide which guides the inner surface of the arcuate driven portion and the upper and lower reaches of the feed belt is positioned in longitudinally aligned relation to the feed pins of the feed belt and has a width substantially equal to the diameter of the feed pin, so that the guide surface of the belt guide may effectively guide the arcuate driven portion and the upper and lower reaches of the feed belt. In other words, the friction produced between the inner surface of the feed belt and the guide surface of the belt guide may be reduced, permitting lighter travel of the feed belt. Furthermore, in the upper reach, the feed belt may be positively prevented from being deflected in such a direction as to cause disengagement of the feed pins from the associated perforations in the continuous web.

When the continuous web undergoes an external force greater than the meshing force between the belt teeth of the arcuate driving portion of the feed belt and the pulley teeth of the driving pulley, the arcuate driving portion of the feed belt tends to move outwardly from the driving pulley. The belt restraining extension restrains such outward movement of the feed belt and thereby maintain the meshing engagement between the belt teeth of the arcuate driving portion of the feed belt and the pulley teeth of the driving pulley.

The present invention will become more fully apparent from the claims and description as it proceeds in connection with the drawings.

DETAILED DESCRIPTION OF THE PREFERRED EMBODIMENT

Figure 1:
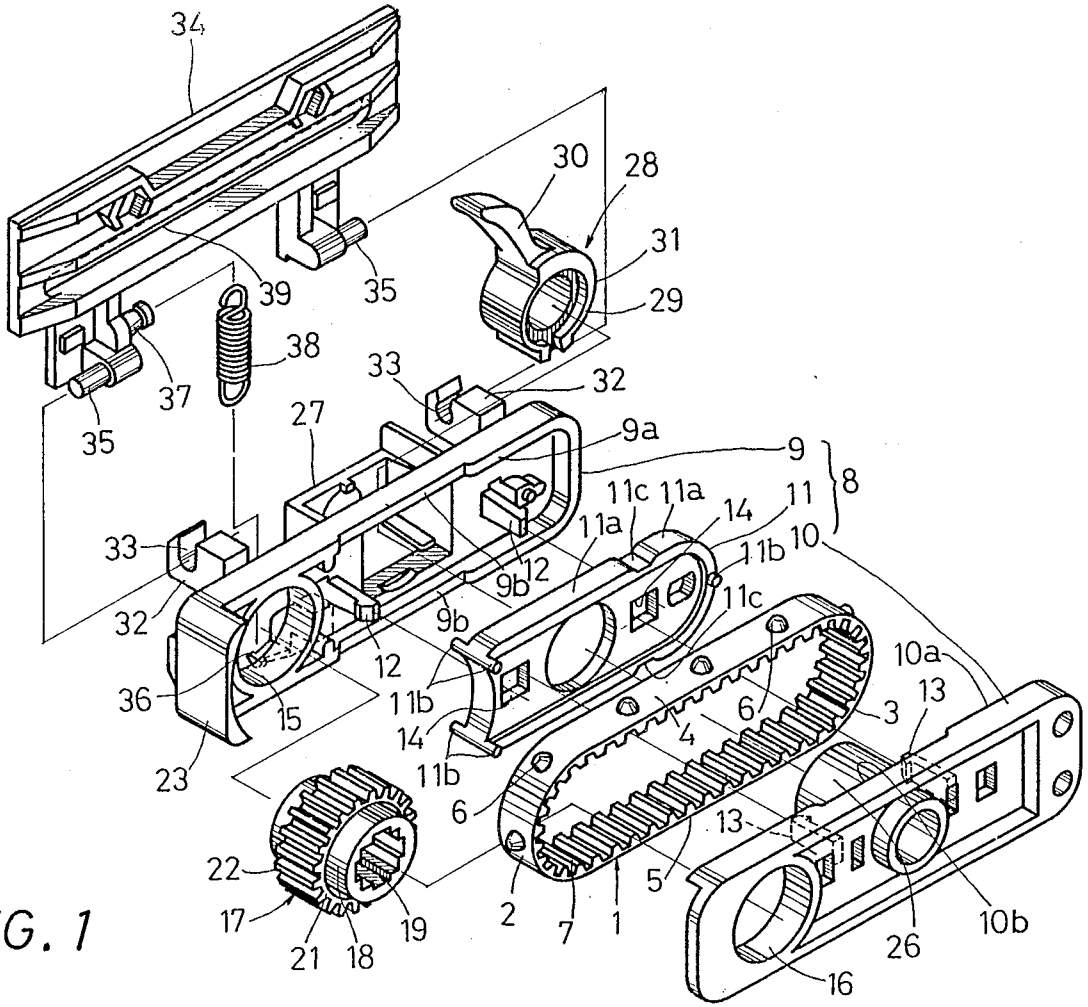
FIG. 1 is an exploded perspective view of a web feed tractor according to a preferred embodiment of the present invention.
Figure 2:
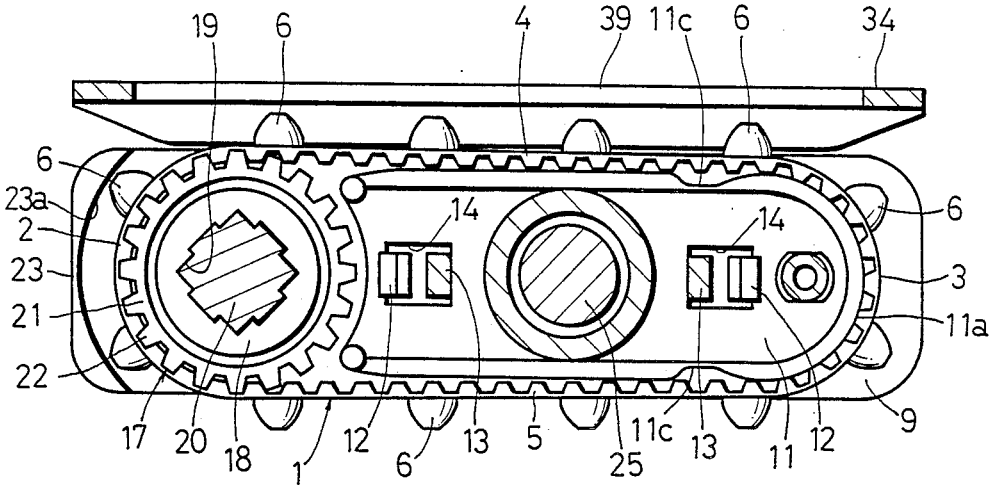
FIG. 2 is a sectional side view of the web feed tractor of FIG. 1.
Figure 3:
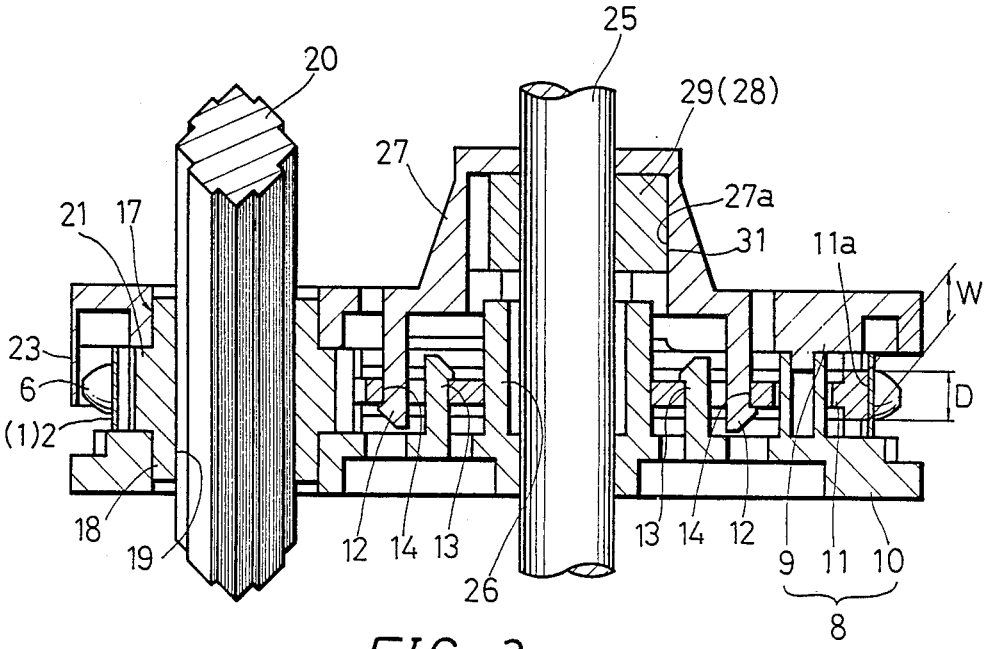
FIG. 3 is a sectional plan view of the web feed tractor of FIG. 1.

Referring now to FIGS. 1, 2 and 3, shown therein is a web feed tractor constructed in accordance with the present invention. As shown therein, the web feed tractor has an endless feed belt 1 including an arcuate driving portion 2, an arcuate driven portion 3 and upper and lower reaches 4 and 5 extending between these arcuate driving and driven portions 2 and 3. The feed belt 1 has a predetermined number of feed pins 6 projecting from the outer surface thereof at predetermined intervals, the feed pins 6 being engageable with equispaced perforations formed in a continuous web (not shown) along its opposite marginal edges. The inner surface of the feed belt 1 has a plurality of belt teeth 7.

The feed belt 1 is supported by a frame assembly 8 composed mainly of three members. These members are a pair of side frames 9 and 10 which support the opposite edges of the feed belt 1 and an intermediate belt guide 11 disposed between the side frames 9 and 10 and adapted to guide the arcuate driven portion 3 and the upper and lower reaches 4 and 5 of the feed belt 1.

The side frames 9 and 10 are formed, respectively, with pairs of front and rear connecting pawls 12 and 13 projecting from the opposite surfaces thereof. The belt guide 11 has front and rear square locking holes 14 with which the connecting pawls 12 and 13 are resiliently engageable. Thus, these three members are connected as an assembly by resiliently engaging the connecting pawls 12 and 13 of the side frames 9 and 10 with the locking holes 14 of the belt guide 11.

A through hole 15 is formed adjacent one end of the side frame 9, and a concentric through hole 16 is formed adjacent one end of the side frame 10. The holes 15 and 16 are adapted to receive rotatably therein opposite ends of a boss 18 of a driving pulley 17 now to be described. This driving pulley 17 has at the center of the boss 18 a square through hole 19 through which a square driving shaft 20 extends to transmit torque to the driving pulley 17, the latter being axially movable on the driving shaft 20. The driving pulley 17 also has a large diameter pulley portion 21 formed centrally on the outer periphery thereof. The pulley portion 21 has on the outer periphery thereof pulley teeth 22 adapted to mesh with the belt teeth 7 of the arcuate driving portion 2 of the feed belt 1, so that the feed belt 1 may be driven by rotation of the driving pulley 17.

The side frame 9 also has on one end thereof an arcuate belt restraining extension 23 formed in slightly spaced apart relation to the top of the feed pin 6 on the outer surface of the arcuate driving portion 2 of the feed belt 1 and adapted to restrain outward movement of the driving arcuate portion 2. The curvature of the belt restraining extension 23 is such that at least one feed pin 6 may be located on the arcuate driving portion 2 of the feed belt 1. In other words, the length of the arcuate surface 23*a* of the belt restraining extension 23 is set suitably longer than the distance between two adjacent feed pins 6 of the feed belt 1, as shown in FIG. 2.

The belt guide 11 has a guide surface 11*a* adapted to engage the arcuate driven portion 3 and the upper and lower reaches 4 and 5 of the feed belt 1 so as to guide the inner surface of the belt 1. The guide surface 11*a* extends in the travelling direction of the feed belt 1 in longitudinally aligned relation to the feed pins 6 of the belt 1. As shown in FIG. 3, the width W of the guide surface 11*a* is so narrow as to be substantially equal to the diameter D of the feed pin 6, so that the friction produced between the inner surface of the feed belt 1 and the guide surface 11*a* of the belt guide 11 may be reduced. The belt guide 11 also has a predetermined number of retaining pins 11*b* projecting from the opposite sides of the front and rear portions thereof. The retaining pins 11*b* have distal ends abutting against the respective opposite surfaces of the side frames 9 and 10 and adapted to maintain the guide surface 11*a* of the belt guide 11 in the longitudinally aligned position relative to the feed pins 6 of the feed belt 1. The guide surface 11*a* of the belt guide 11 has relief grooves 11*c* of a predetermined length formed between an arcuate guide surface opposite to the arcuate driven portion 3 of the feed belt 1 and linear guide surfaces opposite to the upper and lower reaches 4 and 5 and adapted to reduce its contact area with the inner surface of the feed belt 1.

The side frames 9 and 10 further have belt support surfaces 9*a* and 10*a* formed, respectively, in the upper and lower portions of the opposite surfaces thereof and adapted to support the opposite edges of the upper and lower reaches 4 and 5 of the feed belt 1. As shown in FIG. 1, the belt support surfaces 9*a* and 10*a* have longitudinally extending, cutout relief grooves 9*b* and 10*b* formed, respectively, in portions opposite to the medial portions of the upper and lower reaches 4 and 5 of the feed belt 1 and adapted to avoid their abutment against the edges of the feed belt 1. Consequently, the friction produced between the support surfaces 9*a* and 10*a* of the side frames 9 and 10 and the opposite edges of the feed belt 1 is reduced.

With continuing reference to FIG. 1, the side frame 10 is provided generally in the medial portion thereof with a cylindrical boss 26 which is axially movably fitted onto a support shaft 25 which will be explained later.

Figure 4:
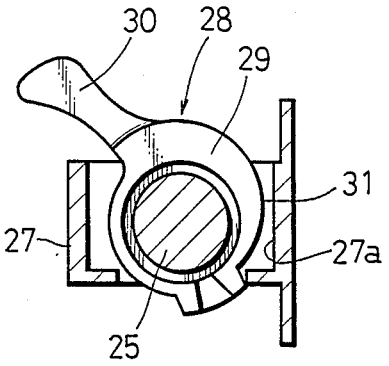
FIG. 4 is a sectional view showing the cam surface of the locking lever and the engaging surface of the retaining compartment in disengaged position.
Figure 5:
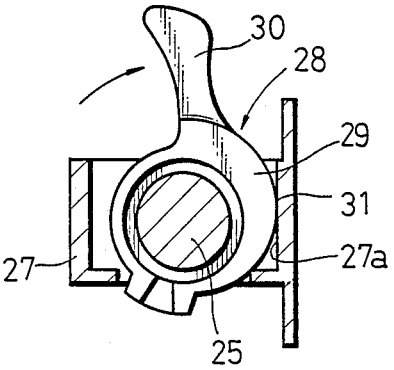
FIG. 5 is a sectional view showing the cam surface and the engaging surface in locked position.

The side frame 9 is provided with a retaining compartment 27 having an open top and adapted to accommodate therein a locking lever 28 for releasably locking the frame assembly 8 on the support shaft 25 at a desired position. As best shown in FIGS. 4 and 5, the retaining compartment 27 is formed on an inner side wall surface thereof with an engaging surface 27*a* engageable with the locking lever 28.

As shown in FIGS. 1, 3, 4 and 5, the locking lever 28 is mainly composed of a boss portion 29 having a central bore (unnumbered) through which the support shaft 25 is inserted and a handle portion 30 integrally formed with and projecting from the outer periphery of the boss portion 29. The boss portion 29 of the locking lever 28 is inserted through the top opening of the retaining compartment 27, and the support shaft 25 is inserted through the central bore thereof, with the handle portion 30 projecting outwardly through the opening of the retaining compartment 27 for manual actuation. The boss portion 29 of the locking lever 28 has on the outer periphery thereof a cam surface 31 whose radius of curvature gradually increases in the counterclockwise direction, as viewed in FIG. 4, around the center of the support shaft 25. As shown in FIG. 5, when the locking lever 28 is pivoted in the clockwise direction, the cam surface 31 is brought into engagement with the engaging surface 27*a* of the retaining compartment 27, so that the frame assembly 8 may be locked at a desired position on the support shaft 25 to conform to various width webs.

The side frame 9 is further provided with a pair of front and rear bearing pieces 32 having upwardly opening grooves 33 and adapted to receive a holder plate 34. The holder plate 34 has hinge pins 35 integrally formed therewith on one side and adapted to be pivotally inserted through the grooves 33, so that the holder plate 34 is pivotable between an open position and a closed position around the hinge pins 35. When held in the closed position in which it overlies the top surfaces of both side frames 9 and 10, the holder plate 34 prevents upward movement of the continuous web. The holder plate 34 and the side frame 9 are provided with spring pegs 36 and 37, respectively, between which a tension spring 38 is attached, so that the holder plate 34 may be urged to the open position and the closed position under the action of the spring 38. The holder plate 34 has a longitudinally extending slot 39 in which the feed pins 6 of the feed belt 1 may travel.

The side frames 9 and 10, belt guide 11, driving pulley 17 and other component parts are made of synthetic resin material and especially, the belt guide 11 is made of synthetic resin material having a small friction coefficient.

In actual use, a pair of right-hand and left-hand web feed tractors thus constructed are disposed axially movably on the driving shaft 20 and the support shaft 25. As is known, the driving shaft 20 and the support shaft 25 are disposed between frames of a printer or a computer, and the driving shaft 20 is rotated through a suitable driving unit from a power source, such as an electric motor.

In the embodiment thus constructed, the feed pins 6 on the respective feed belts 1 of the right-hand and left-hand web feed tractors are engaged with the associated perforations on the opposite sides of the continuous web. The holder plates 34 are closed to complete setting of the continuous web. With this condition existing, the driving pulley 17 is rotated in a predetermined direction by the driving shaft 20 to drive the feed belts 1, causing the continuous web to be fed in the predetermined direction. While the feed belt 1 is being driven, the arcuate driven portion 3 and the upper and lower reaches 4 and 5 of the feed belt 1 are guided in contacting engagement with the guide surface 11*a* of the belt guide 11.

The guide surface 11*a* of the belt guide 11 is positioned in longitudinally aligned relation to the feed pins 6 of the feed belt 1 and has a width substantially equal to the diameter of the feed pin 6, so that the friction produced between the arcuate driven portion 3 and the upper and lower reaches 4 and 5 of the feed belt 1 and the guide surface 11*a* of the belt guide 11 may be reduced, permitting lighter and smoother travel of the feel belt 1.

Furthermore, the upper and lower reaches 4 and 5 of the feed belt 1 are guided by the guide surface 11*a* of the belt guide 11 in aligned relation to the feed pins 6, so that the upper and lower reaches 4 and 5 of the feed belt 1 may be positively prevented from being deflected in such a direction as to cause disengagement of the feed pins 6 from the perforations in the continuous web.

While the feed belt 1 is being driven, the continuous web may undergo an external force greater than the meshing force between the belt teeth 7 of the arcuate driving portion 2 of the feed belt 1 and the pulley teeth 22 of the driving pulley 17, causing the arcuate driving portion 2 of the feed belt 1 to move outwardly from the pulley teeth 22 of the driving pulley 17. In such a case, however, the feed pins 6 on the arcuate driving portion 2 are brought in contact with the arcuate surface 23*a* of the belt restraining extension 23 so as to restrain outward movement of the arcuate driving portion 2. As the result, slip, jumping or other difficulties of the feed belt 1 caused by such an outward movement of the arcuate driving portion 2 may be positively prevented.

While the invention has been described with reference to a preferred embodiment thereof, it is to be understood that modifications or variations may be easily made without departing from the spirit of this invention which is defined by the appended claims.

What is claimed is:

1. A web feed tractor comprising:

an endless feed belt having an arcuate driving portion, an arcuate driven portion and upper and lower reaches extending between said arcuate driving and driven portions, said feed belt having on an outer surface thereof a predetermined number of feed pins engageable with equispaced perforations formed in a continuous web;

a pair of side frames disposed along opposite edges of said feed belt and having pairs of front and rear connecting pawls projecting from opposite surfaces thereof facing to each other, respectively;

a driving pulley rotatably supported between one end of said side frames and adapted to engage inner surface of said arcuate driving portion of said feed belt so as to drive said feel belt; and a belt guide which is not integrally formed with a side frame disposed between said side frames including front and rear portions and having a guide surface adapted to guide the inner surface of said arcuate driven portion and said upper reach of said feed belt and having a width substantially equal to the diameter of said feed pin, including front and rear locking holes with which said connecting pawls provided on said side frames are to be engaged and a plurality of retaining pins including distal ends and projecting from the opposite sides of the front and rear portions thereof, thereby said belt guide surface provided on said belt guide being positioned in longitudinally aligned relation to said feed pins of said feed belt when said belt guide and said side frames are connected as an assembly by abutting distal ends of said retaining pins provided on said belt guide against the respective opposite surfaces of said side frames and engaging said connecting pawls provided on said side frames with said locking holes provided on said belt guide.

2. The web feed tractor as defined in claim 1, wherein one of said side frames is formed with an arcuate belt restraining extension extending outwardly of and closely along an outer surface of said arcuate driving portion of said feed belt and adapted to restrain outward movement of said feed belt.

3. The feed tractor as defined in claim 1, wherein a belt support surface is formed, respectively in the opposite surfaces of said side frames for supporting opposite side edges of said upper and lower reaches of said feed belt and a longitudinally extending cutout relief groove is formed in said belt support surfaces, respectively, in portions facing to the medial portions of said upper and lower reaches of said feed belt.

4. The feed tractor as defined in claim 1, wherein a relief groove of a predetermined length is formed, respectively, in said guide surface provided on said belt guide in a position between guide surfaces adapted to guide the inner surface of said arcuate driven portion and said upper reach of said feed belt and in a position between guide surface adapted to guide the inner surface of said arcuate driven portion and said lower reach of said feeding belt.

* * * * *